United States Patent [19]

Shedd

[11] 4,429,826

[45] Feb. 7, 1984

[54] SLIP CASE FOR FILING BOX

[75] Inventor: David E. Shedd, Barrington, R.I.

[73] Assignee: Taylor Box Co., Warren, R.I.

[21] Appl. No.: 470,005

[22] Filed: Feb. 28, 1983

[51] Int. Cl.[3] ..... B65D 13/06; B65D 5/38

[52] U.S. Cl. ..... 229/23 BT; 229/9; 229/40

[58] Field of Search ..... 229/9, 19, 40, 44 CB, 229/23 BT

[56] References Cited

U.S. PATENT DOCUMENTS 895,508 8/1908 Smith ..... 229/40
1,152,352 8/1915 Schwerdtle ..... 229/40
1,203,003 10/1916 Jones ..... 229/40
4,125,189 11/1978 Fujimoto ..... 229/19

FOREIGN PATENT DOCUMENTS 420972 3/1967 Switzerland ..... 229/40

*Primary Examiner*—Herbert F. Ross
*Attorney, Agent, or Firm*—Barlow & Barlow

[57] ABSTRACT

A slip case which has an inner part that slides within an outer part is disclosed, the slip case being constructed with a one-piece outer cover for the outer part and a one-piece cover for the inner part so that the printed matter that lies on the cover will properly register between the two parts.

2 Claims, 6 Drawing Figures

SLIP CASE FOR FILING BOX

BACKGROUND OF THE INVENTION

This invention relates in general to filing boxes of the type wherein an inner element is adapted to slide within an outer element, the box providing an inexpensive means of providing a book-like construction which may hold magazines, and other relatively thin objects to provide an attractive appearance. The file box is wrapped with a cover which is of novel form and is made in one piece with a minimum amount of stock, the cover being tightly applied about the exterior walls of the outer part of the slip case so as to give a neat finished appearance.

In the past it has been customary to wrap file boxes with a several-part outer cover and in this way, at least one of the walls of the box is covered with a single sheet of material, which sheet or blank tends to cover all of the edges. This is not entirely satisfactory as it does not provide a perfect finished appearance, and also when decorative labeling is placed on the cover, it does not allow for proper registration of the decorative material.

SUMMARY OF THE INVENTION

The slip case of the instant invention comprises an inner part and an outer part which are adapted to slide together and to form one integral file filing box. The outer part is essentially of rectangular form to have one open wall, while the inner part which slips within the outer part, is formed of two partial side walls and a bottom and front so that when slipped into the outer part, the front will close the open wall of the outer part. The covering for the outer part is a one-piece cover which has a dimension that will totally overly all of the walls, and the cover similarly for the inner part is of one-piece construction which overlies all of the walls, each cover being properly die cut to achieve the end result. By the use of registration holes identical arrangement and registration of the covers is possible so that each cover as it is placed about the respective element will align properly with all the printed matter that may lie thereon. It is accordingly the important object of the invention to provide a wrapper blank especially constructed and prepared for the application to an outer part of a slip case that resides to a large measure in the manner in which the cover is applied to the box and adhesively affixed thereto to provide a smooth, neat and attractive box.

DESCRIPTION OF THE PREFERRED EMBODIMENT

Figure 1:
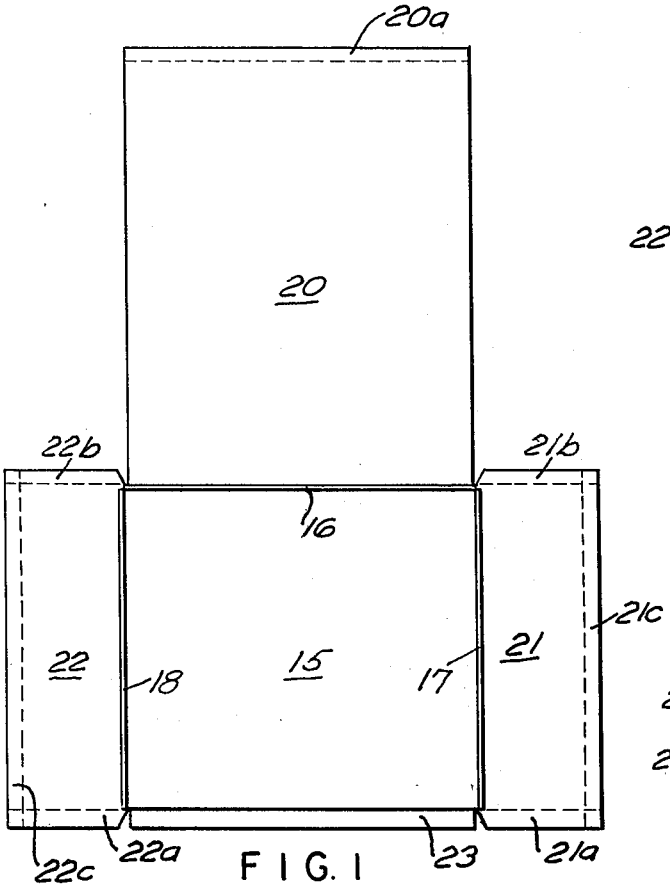
FIG. 1 is a top view of the first stage in covering and manufacturing the outer case in accordance with the invention.
Figure 2:
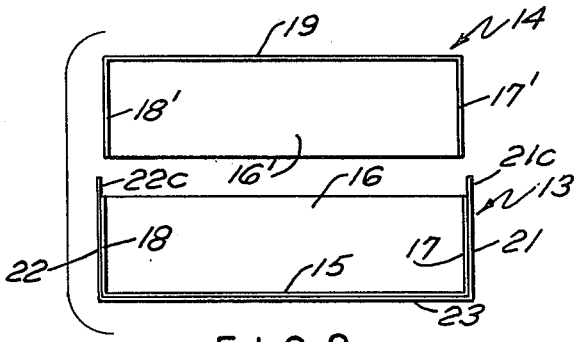
FIG. 2 illustrates a second step thereof where two halves of the outer case are brought together.
Figure 3:
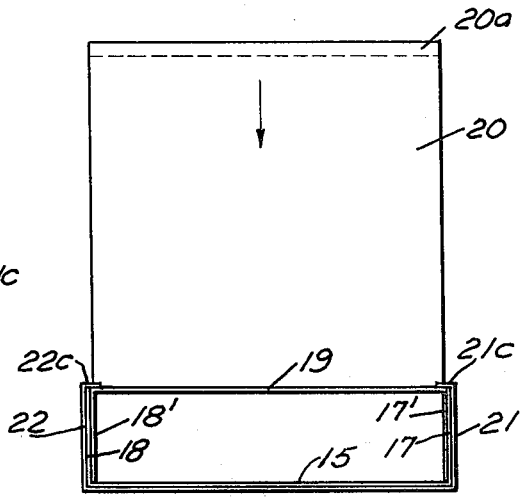
FIG. 3 shows a third and fourth stage of manufacture.
Figure 4:
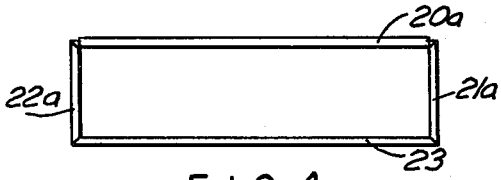
FIG. 4 is an end view illustrating the completely covered outer container.

The slip case consists of an outer part 11 and an inner part generally designated 12 (see FIG. 6) which are formed from semi-rigid materials, such as ordinary cardboard. The outer part is formed from two blanks 13 and 14 as seen in FIG. 2, the blank 13 having a side wall 15, back wall 16 and top and bottom walls 17 and 18, which are held together by tape at the joints between the walls 16 and 17 and 16 and 18 respectively, into the erect form as seen in FIGS. 1 and 2. The part 14 is folded in such a way as to snuggly fit within the part 13 and it too has a side wall 19, top and bottom walls 17', 18' and a back wall 16'.

The outer part is covered with material such as a coated fabric that has a design on its outer surface to present a pleasing appearance after assembly. This cover which is depicted in flat form in FIG. 1, has a main body portion 20 and adjacent one end thereof, are flaps 21, 22 and 23. For assembly purposes the cover blank is glued on one side thereof and placed down on a flat surface and then the outer first part 13 of cover part 11 is placed thereon as seen in FIG. 1. The flap 23 is then folded over the edge of and onto the side wall 15 and the flaps 21 and 22 are brought upwardly (see FIG. 2). The second part 14 is then dropped into the first part 13, the edges **21*b* and 22*b* are folded over the wall 16, the edges 21*c* and 22*c* are folded over the wall 19, and the major cover part 20 is then rolled up the back wall 16 and thence over the side wall 19 with the end flaps 20*a*, 21*a* and 22*a* being tucked inwardly over the edge of the walls 19, 17 and 18** respectively to form a completely covered unit.

Figure 5:
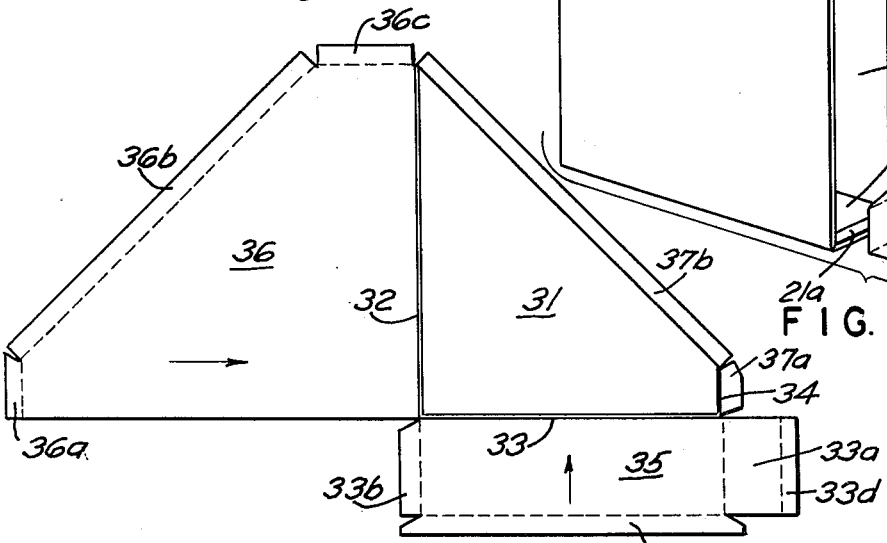
FIG. 5 is a partially diagrammatic top view illustrating the manner in which the inner part is covered by a one-piece outer cover.
Figure 6:
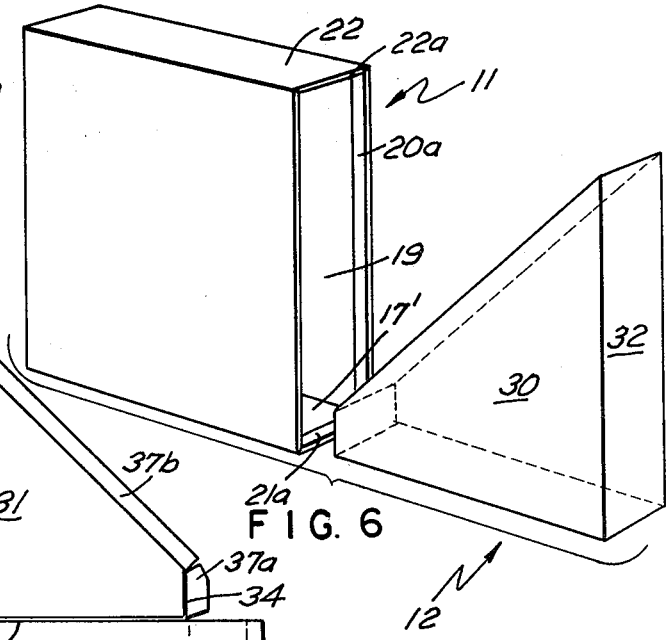
FIG. 6 is a detached perspective view showing the completed article.

The inner part 12, which is shown in FIGS. 5 and 6, may also be formed from a semi-rigid material such as cardboard and consists essentially of a blank which is creased and folded to provide side walls 30 and 31, a front wall 32, a bottom wall 33 and a flap 34 that extends from the bottom wall 33 for a short distance to run between the two side walls 30 and 31. The side walls as seen in the drawings are substantially cut away to form a partially open container. It is desirable to cover the inner part as was done with the outer part, to provide a pleasing appearance; and, to this end, a blank is cut as seen in FIG. 5 and by holding the inner part 12 in a suitable dies, it is placed in registry on top of a side wall covering which is not seen in FIG. 5, but which is covered by the side wall 30. At this point, the flap 35 is folded up over the bottom wall 33 with the edge portion **33*a* folded on top of the wall 31 and the flap 33*b* folded on to the front wall 32 with the flap 33*c* folded over the retainer lip wall 34. The edge 33*b* is folded on to the front wall 32 and the next step in the operation is to have the portion 36 folded up over the front wall 32 and thence over the retainer lip wall 31 with the edges 36*a* folded over the wall 34. Flap 37*a* is folded onto the wall 34 and then flap 33*c* is folded on to wall 34 and the flaps 33*d*, 37*b*, 36*b* and 36*c* are folded over the edges of the walls of the inner container to complete the covering. The inner container may easily slip into the outer and is provided with a retaining lip wall 34** to prevent articles from falling out of the inner part as it moves in and out of its case.

By utilizing positioning guides for the cover parts, and gripping dies for the box inner and outer parts, alignment of the cover is assured.

I claim:

1. A slip case comprising an inner part and an outer part, the inner part having a bottom, front and side walls with a retainer lip joining the peripheries of the bottom and a portion of the side walls contiguous to the bottom wall opposite said frot wall to define an opening, said lip having a height substantially less than the height of said front wall; the outer part comprising a rectangular form having back, two sides, top and bottom walls, the sides, top and bottom walls defining an open front to receive the inner part; a one-piece outer cover for the outer part of a dimension to totally overlie the back and said two side walls and having a pair of flaps extending from opposite sides of that portion of said outer cover which overlies one of said sides, said flaps having a width greater than the top and bottom wall width, said flaps folding over the top and bottom walls and partially down the other of said side walls, the cover over the other of said walls overlying the edges of the flaps.

2. A slip case as in claim 1 wherein the inner part has a one-piece cover embracing the front and side walls and a flap portion folded over the bottom wall.

* * * * *